US005657055A

United States Patent [19]

Kansal et al.

[11] Patent Number: 5,657,055

[45] Date of Patent: Aug. 12, 1997

[54] METHOD AND APPARATUS FOR READING AHEAD DISPLAY DATA INTO A DISPLAY FIFO OF A GRAPHICS CONTROLLER

[75] Inventors: Arvind K. Kansal, Cupertino; Thomas C. Yip, Los Gatos, both of Calif.

[73] Assignee: Cirrus Logic, Inc., Fremont, Calif.

[21] Appl. No.: 477,019

[22] Filed: Jun. 7, 1995

[51] Int. Cl.[6] ..... G09G 5/00

[52] U.S. Cl. ..... 345/189; 345/196; 345/200; 345/185

[58] Field of Search ..... 345/185, 189, 345/190, 196, 197, 200

[56] References Cited

U.S. PATENT DOCUMENTS

| | | | |
|---|---|---|---|
| 4,628,467 | 12/1986 | Nishi et al. | 345/200 |
| 5,335,322 | 8/1994 | Mattison | 345/185 |
| 5,353,402 | 10/1994 | Lau | 345/185 |
| 5,486,876 | 1/1996 | Lew et al. | 345/190 |
| 5,487,146 | 1/1996 | Guttag et al. | 345/200 |
| 5,493,648 | 2/1996 | Murray et al. | 345/185 |
| 5,530,458 | 6/1996 | Wakasu | 345/185 |

*Primary Examiner*—Richard Hjerpe
*Assistant Examiner*—Kent Chang
*Attorney, Agent, or Firm*—Steven A. Shaw; Robert P. Bell

[57] ABSTRACT

A graphics controller that uses two MREQ priority levels (low and high) to retrieve display data from a frame buffer into a CRT FIFO. The graphics controller sends the high priority MREQ signal to a host controller if the data level in the CRT FIFO is below a low level water mark. The graphics controller sends the low priority MREQ signal if the data level in the CRT FIFO is between a high level water mark and a low level water mark, and if a system memory bus is idle. The host controller grants access of the system memory bus to the graphics controller with a higher priority (i.e. above that of other devices such as CPU and I/O devices) in response to the high priority MREQ signal, and with a lower priority in response to the low priority MREQ signal. Upon being granted access to the system memory bus, the graphics controller retrieves display data from the frame buffer. By employing the low priority MREQ signal, the system memory bus is more efficiently utilized and the frequency of high priority MREQ signals is minimized which leads to an overall increase in the throughput performance of the information processing system.

20 Claims, 9 Drawing Sheets

METHOD AND APPARATUS FOR READING AHEAD DISPLAY DATA INTO A DISPLAY FIFO OF A GRAPHICS CONTROLLER

FIELD OF THE INVENTION

The present invention relates to graphics controllers for use in an information processing system. More specifically, the present invention relates to a method and apparatus for reading ahead display data into a CRT FIFO of graphics controller in the information processing system.

BACKGROUND OF THE INVENTION

FIG. 1 shows a block diagram of a prior art information processing system 10 such as a computer system. Information processing system 10 is shown to comprise a central processing unit (CPU) 20, a host controller 40, a system memory 30, a graphics controller 70, a frame buffer 80, and a display unit 60. Display unit 60 can be a flat-panel LCD display or a CRT display or any other type that allows the graphics controller 70 to display information. Host controller 40 controls accesses to a system memory bus 78. Frame buffer 80 is generally implemented as a separate memory unit from the system memory 30.

In operation, CPU 20 generally sends display data to the graphics controller 70, which in turn, writes that display data into the frame buffer 80. It will be appreciated that the display data can be any graphics data or text. Some of the display data can be written from a source other than CPU 20. Graphics controller 70 periodically refreshes a screen on display unit 60 using the display data stored in frame buffer 80.

FIG. 2 shows a block diagram of another prior art information processing system 100. This information processing system 100 differs from the information processing system 10 in that the frame buffer is implemented along with the system memory in a single memory unit 130. Such a single memory unit has been implemented typically in order to take advantage of the increasingly higher capacity DRAM memories available and to reduce the number of components, thereby decreasing the cost of the overall information processing system 100.

The prior art graphics controllers may also include a CRT FIFO 190 (conceptual model shown in FIG. 3) for reading ahead display data from frame buffer 130, and displaying that display data on the display unit 160. The display data may be transformed into analog RGB signals using a digital to analog conveyer.

Graphics controller 170 generally waits until the display data in CRT FIFO 190 falls below a certain threshold (shown as low level water mark), and then reads the next piece of display data from system memory/frame buffer 130. In other words, graphics controller 170 reads next piece of display data when the data stored in CRT FIFO 190 falls below a predetermined threshold level.

In order to read the display data from frame buffer 130, graphics controller 170 asserts a memory request (MREQ) signal line. In response, host controller 140 grants access to system memory bus 173 by asserting a memory grant (MGNT) signal line. The graphics controller 170 then reads a burst of bytes that corresponds to next piece of display data to be displayed. This display data is stored in CRT FIFO and subsequently displayed.

In granting access to system memory bus 173 to graphics controller 170, host controller 140 may need to resolve competing access requests for system memory bus 173 from other units such as CPU 120 or I/O device 150. Since system memory bus 173 typically permits access to only one of these units, host controller 140 needs to arbitrate that which one of these units should be allowed access when multiple requests occur at the same time.

Typical prior art host controllers give a high priority to graphics controllers in granting access to system memory bus 173 in order to meet the display data requirements of display unit 160. In one known information processing system, graphics controller 170 is given the highest priority for fetching display data from the frame buffer 130. Such a priority scheme may insure a reliable refresh rate, and hence an acceptable display quality on display unit 160.

However, such a priority system may cause performance degradation of the other units such as CPU 120 or I/O device 150, thereby resulting in the performance degradation of overall information processing system 100. For example, if CPU 120 and graphics controller 170 need access to system memory bus 173 at the same time, CPU 120 will need to wait until graphics controller 170 completes reading the display data from frame buffer 130 because of the higher priority granted to graphics controller 170. To the extent CPU 120 is forced to be idle during this wait, the throughput performance of overall information processing system 100 may be degraded.

In comparison with information processing system 10 of FIG. 1, information processing system 100 of FIG. 2 may experience a significant performance degradation due to the higher priority granted to the display data memory requests of the graphics controller. This is because access to frame buffer in FIG. 2 by graphics controller 170 is via system memory bus 173 which is shared by other units (e.g. CPU, I/O devices), whereas graphics controller 70 of FIG. 1 has a dedicated bus 78 to access frame buffer 80.

It is further well known that system memory bus 173 is idle or unused at other times. It would therefore be desirable that the graphics controller retrieve the display data during this idle time so that system memory bus 173 is available for other units when these units so require. This will ensure that the throughput performance of the overall information processing system is enhanced.

SUMMARY AND OBJECTS OF THE INVENTION

It is therefore an object of the present invention to increase the performance throughput of the overall information processing system.

It is another object of the present invention to read ahead display data from the frame buffer to the CRT FIFO when the system memory bus is idle.

These and other objects of the present invention are achieved by a graphics controller chip in a computer system having a memory unit including both a frame buffer and a system memory. The memory unit is coupled to the system memory bus. A host controller controls access to the system memory bus.

The graphics controller of the present invention includes a FIFO for storing the display data prior to display on a display unit. A RAS snooping circuit in the graphics controller determines Whether the system memory bus is idle by snooping the RAS signal lines of the memory unit.

The graphics controller circuit also includes a water mark determination circuit for determining whether a number of data items stored in the FIFO waiting to be displayed is within a predetermined range as programmed into a high level water mark register.

An MREQ Generation Circuit generates a low priority MREQ signal to the host controller if the number of data items in the FIFO is within the predetermined range and if system memory bus is determined to be idle.

In response to the low priority MREQ signal, the host controller grants graphics controller access to the system memory bus only if other devices (ex. CPU or I/O devices) do not require access to the system memory bus.

The MREQ generation circuit also generates a high priority MREQ signal if the number of data items stored in the FIFO is below the low level water mark signal as in the prior art systems. In response, the host controller grants the graphics controller access to the system memory bus with the highest priority.

Hence, the graphics controller, in accordance with the present invention, takes advantage of the otherwise idle system memory bus, and opportunistically reads ahead the display data from the frame buffer when the system memory bus is determined to be idle. This will allow other units such as CPUs and I/O devices to have earlier access to the system.

DETAILED DESCRIPTION OF THE PREFERRED EMBODIMENT OF THE INVENTION

Figure 1:
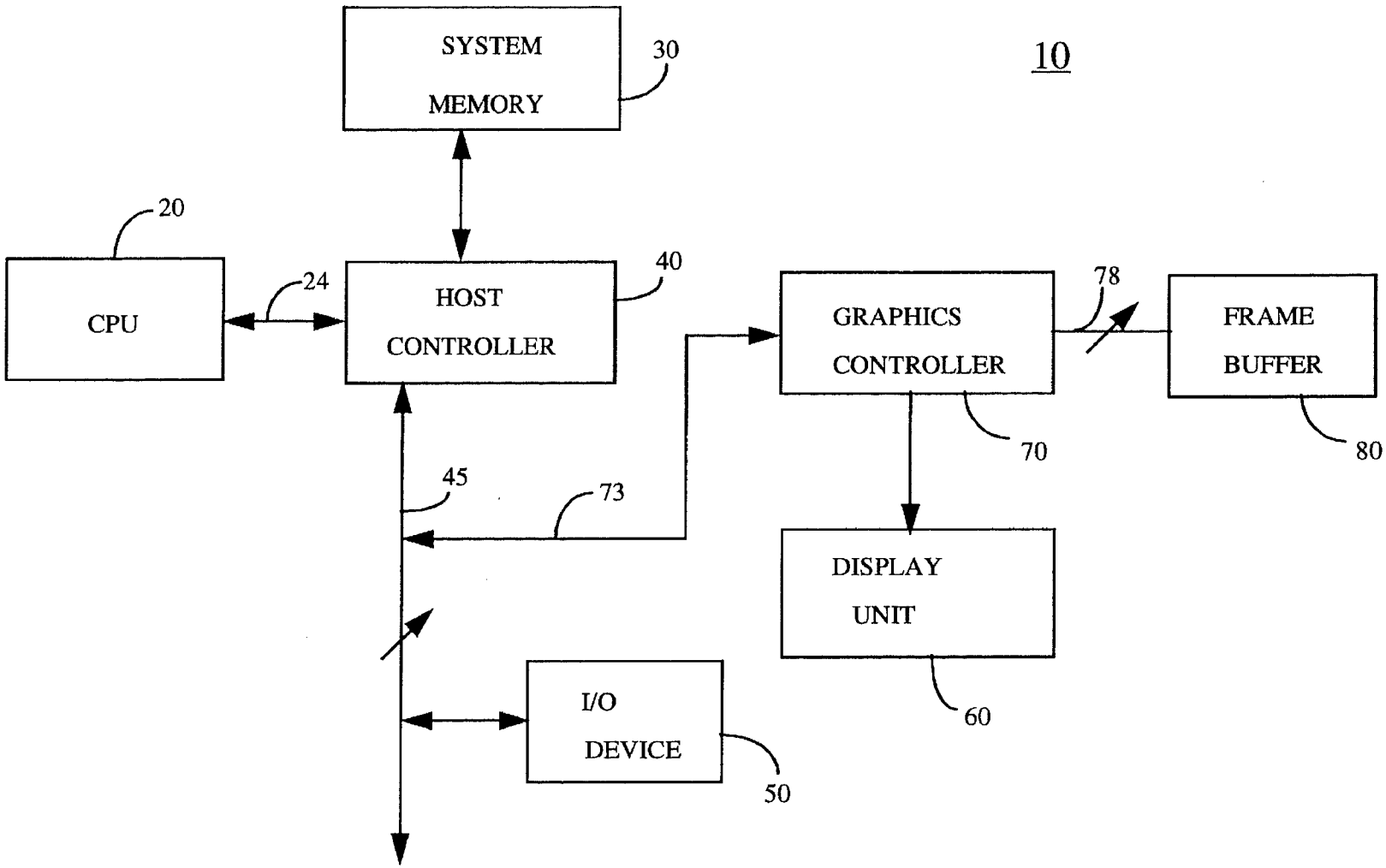
FIGURE 1 (PRIOR ART)
FIG. 1 illustrates a prior art information processing system with a system memory and the frame buffer implemented as separate memory units.
Figure 2:
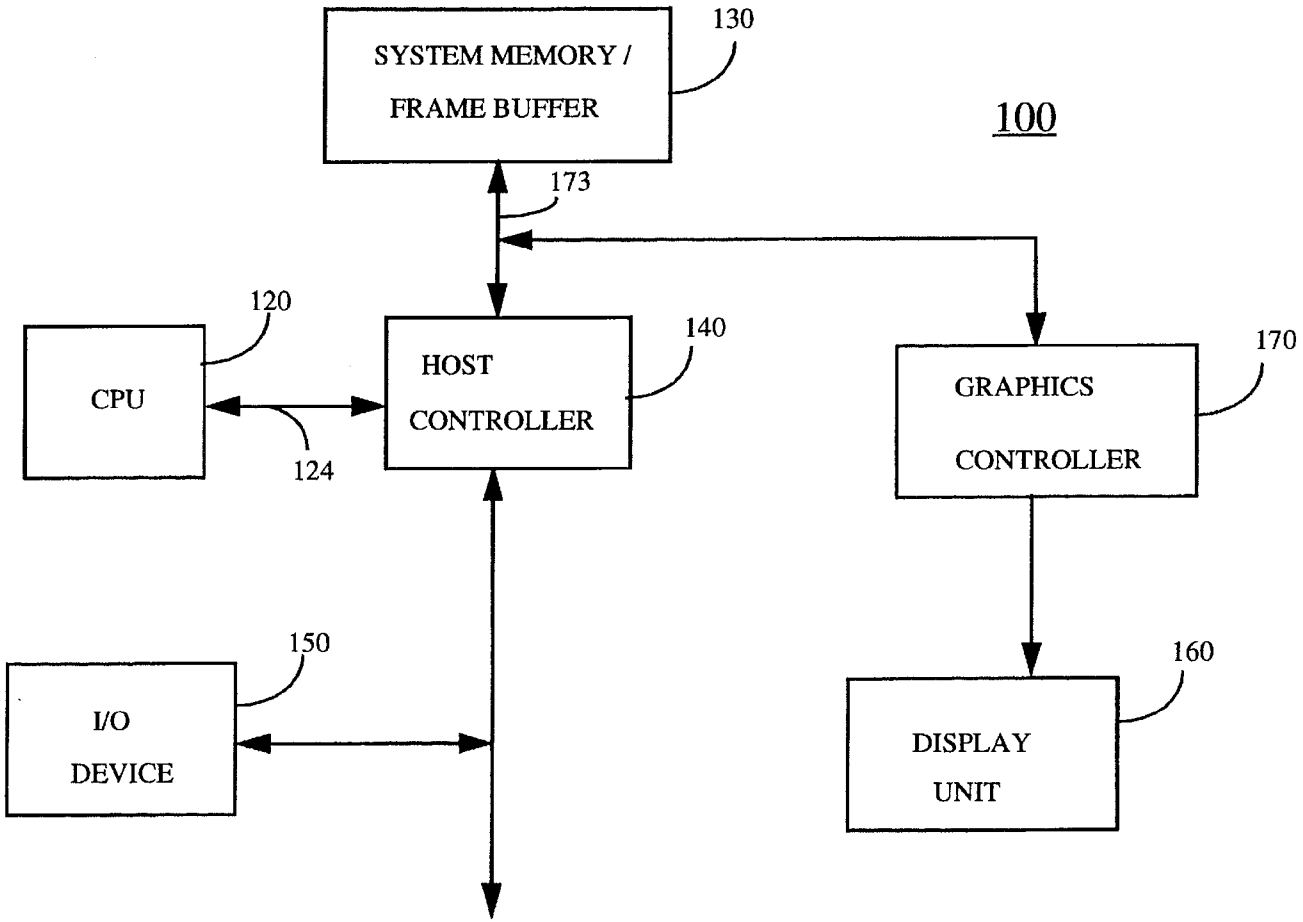
FIGURE 2 (PRIOR ART)
FIG. 2 shows another prior art information processing system with the system memory and the frame buffer implemented in one memory unit.
Figure 3:
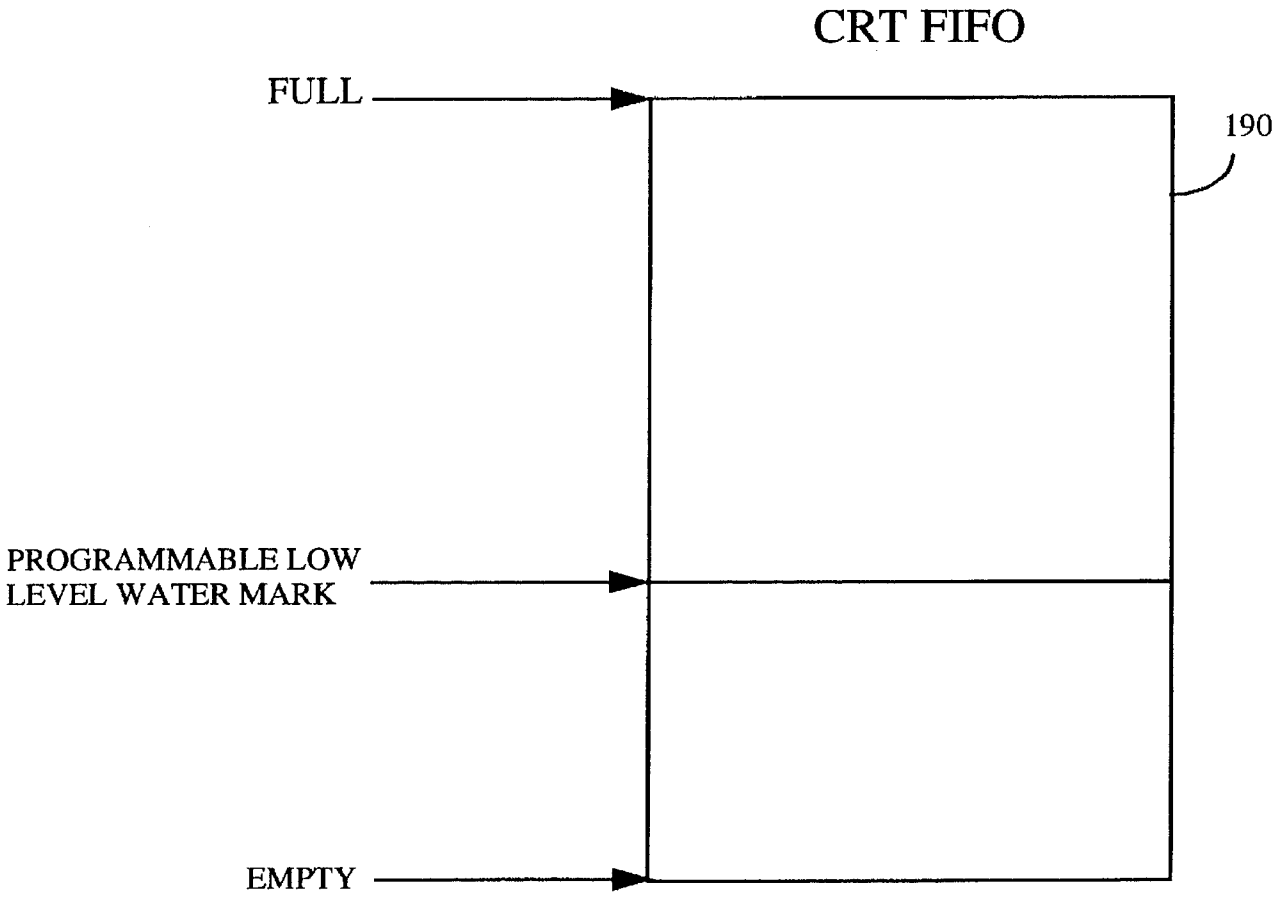
FIGURE 3 (PRIOR ART)
FIG. 3 is a conceptual diagram of the FIFO of the prior art illustrating low level water mark.
Figure 4:
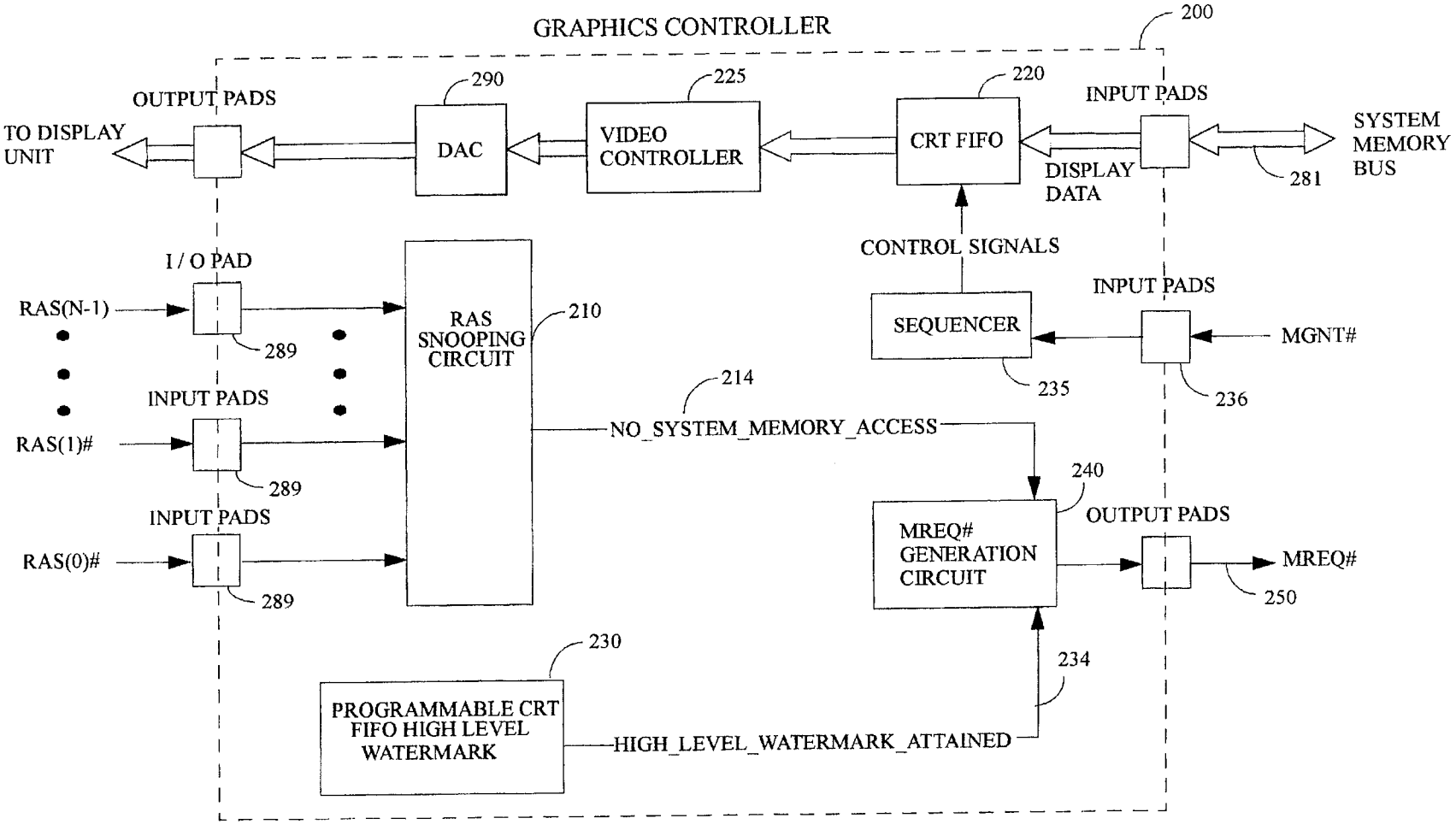
FIG. 4 is a functional diagram of the graphics controller of the present invention comprising a FIFO, a RAS snooping circuit, a water mark determination circuit, and an MREQ Generation Circuit.

FIG. 4 illustrates a block diagram of a graphics controller 200 (in place of graphics controller 170) operable with information processing system 100 in accordance with the present invention. The graphics controller 200 is shown to include a RAS snooping circuit 210, a CRT FIFO 220, a water mark determination circuit 230, a digital to analog converter (DAC) 290, a sequencer 235, a video controller 225, and an MREQ Generation Circuit 240.

The RAS snooping circuit 210 determines whether system memory bus 173 is idle by snooping the RAS lines of system memory/frame buffer 130. If all the RAS lines are logically high, there is no access to system memory/frame buffer 130. Therefore, RAS snooping circuit 210 may comprise an AND logic that would generate a logic 1 if all the RAS lines are high, and a logic 0 otherwise. The system memory bus 173 in the preferred embodiment is idle if there is no access to system memory/frame buffer 130.

The water mark determination circuit 230 of the present invention examines CRT FIFO 220 to determine whether the number of bytes of display data waiting to be displayed in FIFO 220 is within a programmable predetermined range. If so, water mark determination circuit 230 determines that FIFO has attained a high-level water-mark. This is further explained with respect to FIG. 5.

In accordance with the present invention, MREQ Generation Circuit 240 sends either a high priority or low priority MREQ to host controller 140. The MREQ Generation Circuit 240 generates a high priority MREQ signal if the display data in CRT FIFO 220 is below the low level water mark. On the other hand, MREQ Generation Circuit 240 generates a low priority MREQ signal if CRT FIFO 220 has attained a high level water mark and if system memory bus 173 is idle. The MREQ signal 250 is shown as MREQ# to indicate that the signal is active low.

The host controller (such as the one replacing host controller 140) receives the MREQ signal and provides graphics controller 200 access to system memory bus 173 by asserting MGNT signal 236 (shown as MGNT# to indicate that it is active low) to the graphics controller. The host controller may give the highest priority to high priority MREQ signal such that the other units (such as CPU 120 and I/O device 150) get a lower priority than graphics controller 200.

In response to low priority MREQ signal, host controller 140 may give a lower priority to graphics controller 200 over other units. This dual level scheme ensures that graphics controller 200 gets high priority when the data in CRT FIFO 220 is below the low level water mark as in the prior art systems. At the same time, when there is some display data within a programmable range above the low level water mark in CRT FIFO 220, graphics controller 200 of the present invention makes opportunistic read ahead taking advantage of the idle system memory bus 173.

This has the effect of sending fewer high priority MREQ signals to host controller 140 because display data is retrieved into CRT FIFO 220 when system memory bus 173 is idle. Since the frequency of high priority MREQ signal is decreased, the probability that the other units (Ex. CPU and I/O devices) will have immediate or faster access to system memory bus 173 or memory 130 when they so require, is enhanced. This cuts down on the idle time of these other units, and accordingly the overall throughput performance of information processing system 100 is increased.

In order to permit access to system memory bus 173, host controller 140 asserts a memory grant (MGNT) signal in bus 281. On being granted access to system memory bus 173, sequencer 235 initiates retrieval of the next piece of display data from frame buffer 130 using system memory bus 173, and stores it in CRT FIFO 220.

Video controller 225 retrieves the display data from the CRT FIFO 220 and may process the display data to generate bits corresponding to the RGB signals. For example, if display data comprises text data, video controller 225 may convert the text data into RGB bytes corresponding to each pixel on the display unit 160.

DAC 289 receives the RGB bytes from the video controller 225 and converts the RGB bytes to corresponding RGB analog signals for display on the display unit. It will be appreciated that DAC 289 may be located outside graphics controller 200.

Figure 5:
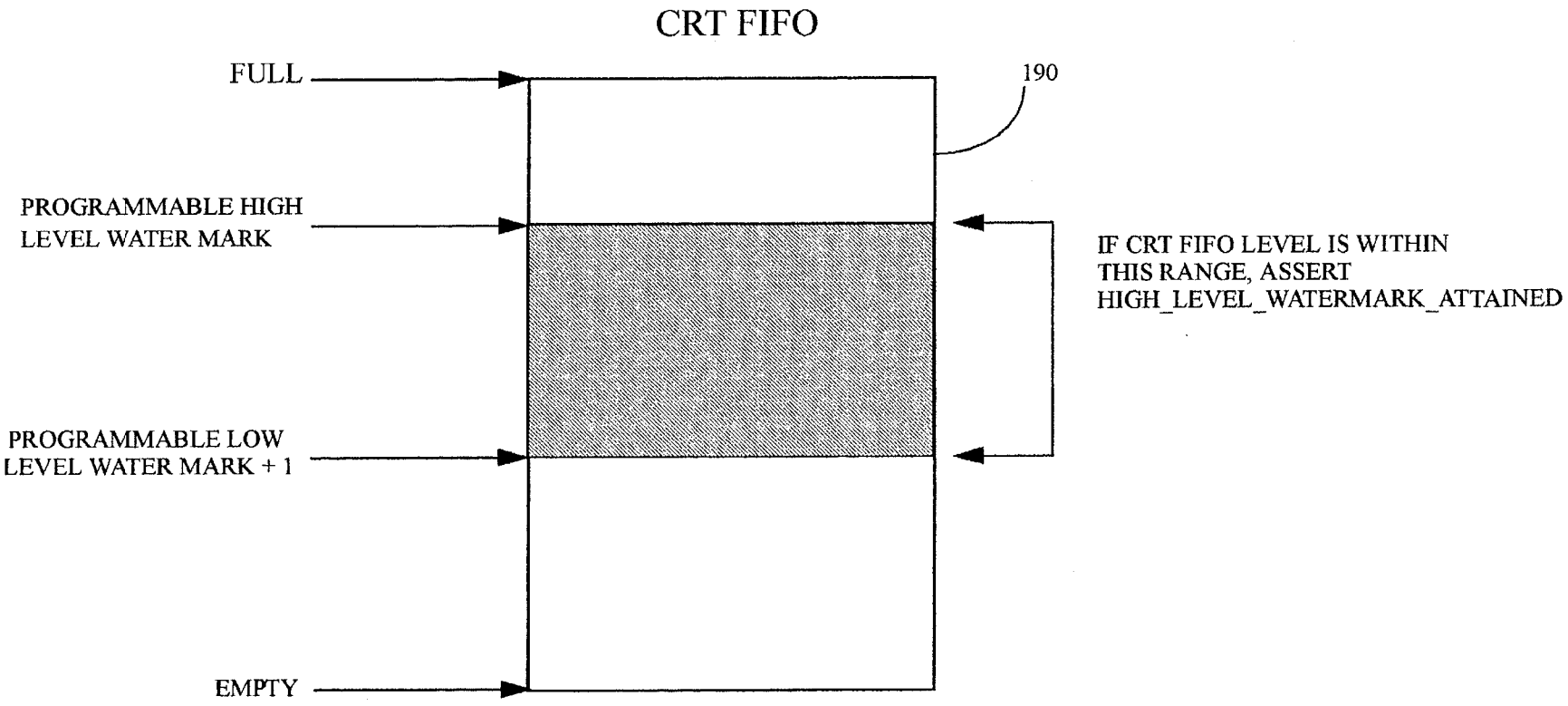
FIG. 5 illustrates the high level water mark and low level water mark as used in relation to the. FIFO of the present invention.

FIG. 5 illustrates the water mark levels in conceptual model of CRT FIFO 220. The use of water mark levels in FIFOs is known in the art. A FIFO level counter indicates the number of entries occupied by display data waiting to be displayed. In the preferred embodiment of the present invention, a CRT FIFO with 28 entries each with 32 number of bits has been implemented. The high level and low level water marks are programmable.

Hence MREQ Generation Circuit 240 generates a high priority MREQ signal if the FIFO level counter is below the low level water mark (e.g. below level 6 in the preferred embodiment). On the other hand, MREQ Generation Circuit 240 generates a low priority MREQ signal when the FIFO level counter is within a range below the high level water mark. This range can be programmed to any value between the full and low level water mark.

Figure 6:
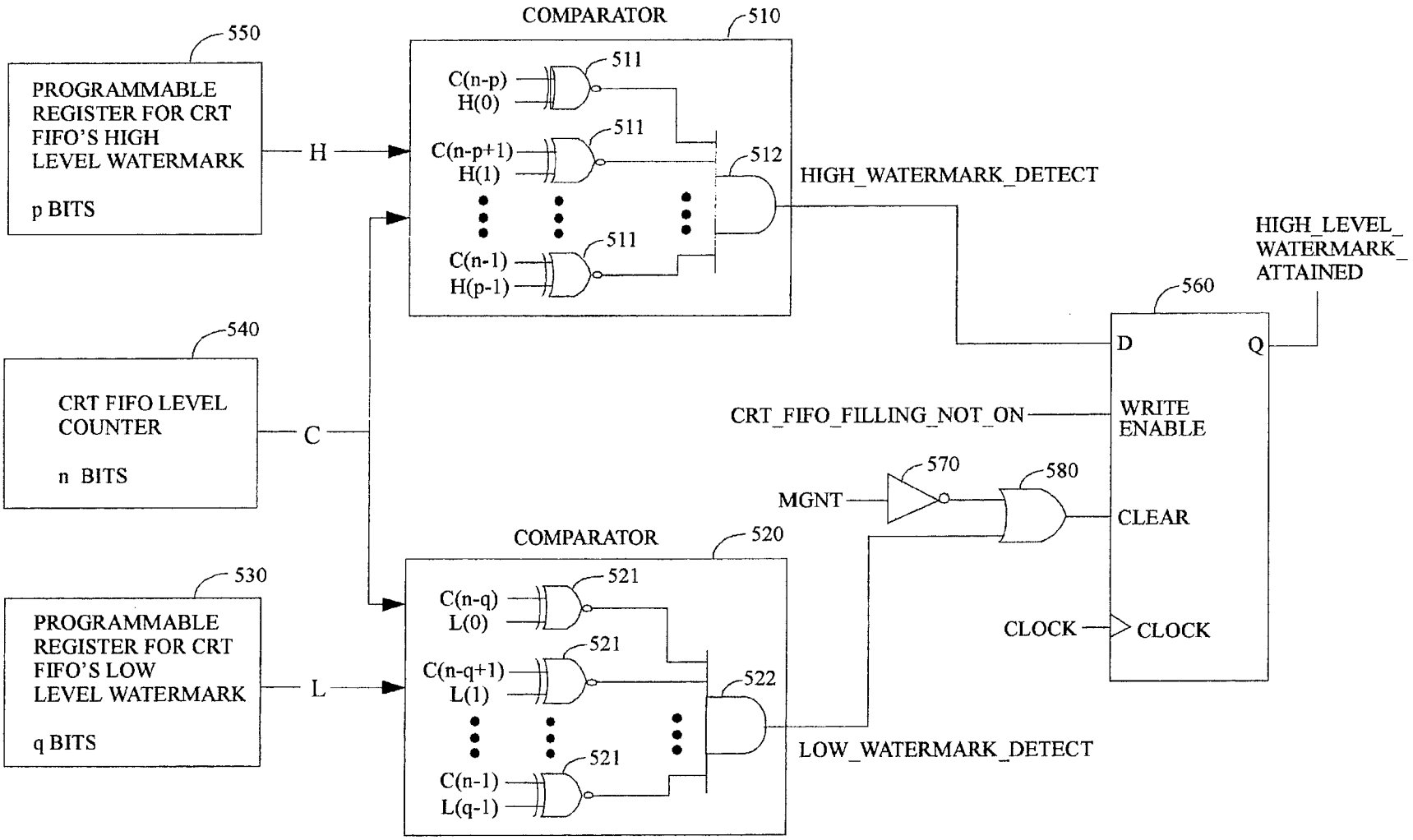
FIG. 6 is a block diagram of the water mark determination circuit of the present invention.

FIG. 6 shows water mark determination circuit 230 that determines whether the data level in CRT FIFO level is below the high level water mark. When the data level is below the high level water mark, the MREQ generation circuit 240 generates a low priority MREQ signal.

The water mark determination circuit 230 comprises two comparators 510, 520 and a delay flip-flop 530. Both comparators receive as inputs a value from a CRT FIFO level counter 540. The comparator 510 is also coupled to a high level water mark register 550, and comparator 520 is coupled to a low level water mark register 530. The outputs of comparators 510 and 520 are coupled to the D and Q inputs of delay flip-flop 560 respectively.

In the preferred embodiment both low level water mark register 530, and high level water mark register 550 are programmable. In order to cover a smaller range of high and low water marks, the registers 530 and 550 can be designed with fewer bits than those in the CRT FIFO level. For example, if CRT FIFO 220 contains between $2^n$ and $2^{n-1}$ 32-bit levels or entries, CRT FIFO level counter 540 may comprise n bits. The registers 530 and 550 may comprise q and p bits respectively, where p, q<n. In the preferred embodiment, n, p and q have been selected to have values of 5, 4, and 4 respectively. It is within the scope and spirit of the present invention to design registers with p, q and n having different values.

The comparator 510 comprises a set of p XNOR gates 511 and an AND gate 512. Each XNOR gate 511 accepts as input a bit (shown as H(x)) in high level water mark register 550, and a corresponding one of the most significant bits (shown as C(x)) of CRT FIFO level counter 540. The outputs of XNOR gates 511 are coupled as inputs to AND gate 512.

The comparator 520 is shown including q XNOR gates 521 and an AND gate 522. Each XNOR gate accepts as input a bit from CRT FIFO low level water mark register 530, and a corresponding one of the most significant bits (i.e. one of q bits) of CRT FIFO counter 540. The outputs of XNOR gates 521 are coupled as inputs to AND gate 522.

The output of comparator 510 is a logic 1 when the CRT FIFO level counter 540 is equal to or less than the value programmed in high level water mark register 550, and a logic 0 otherwise. For example, if p=4, q=4 and n=5 where p is programmed to a value of 1011 (binary), and q is programmed to a value of 0110 (binary), then the output of comparator 510 is a logic 1 if the binary range of CRT FIFO levels equal to 1011X through 0111X. This range corresponds to the range of CRT FIFO levels equal to high water mark through (low water mark+1).

The output of comparator 520 is a logic 1 when the FIFO level counter equals to, or is below the low level water mark programmed in the low level water mark level counter 530.

The flip-flop 560 passes on the output of comparator 510 to the output Q when Write Enable condition is met and Clear condition is not met. However, the Q-output is cleared or set to a logic 0 by the output of comparator 520 when either the CRT FIFO level counter reaches the low level water mark or when MGNT signal is active. The Write Enable input of flip-flop 560 allows the Q output to be a logic 1 only when CRT FIFO 220 is not being filled from display data read from the frame buffer.

Referring to FIG. 4 again, MREQ generation circuit 240 generates a high priority MREQ signal if the CRT FIFO data level is below the low level water mark, and a low priority MREQ signal if CRT FIFO level is within the range defined by high level water mark register 550.

In the preferred embodiment, graphics controller 200 uses a single signal line (MREQ signal line 250) to generate both the high priority and the low priority MREQ signals. It will however be evident to one skilled in the art that a different signaling scheme (for example different signal lines for high priority and low priority MREQ signals) can be employed without departing from the scope and spirit of the present invention.

Figure 7A:
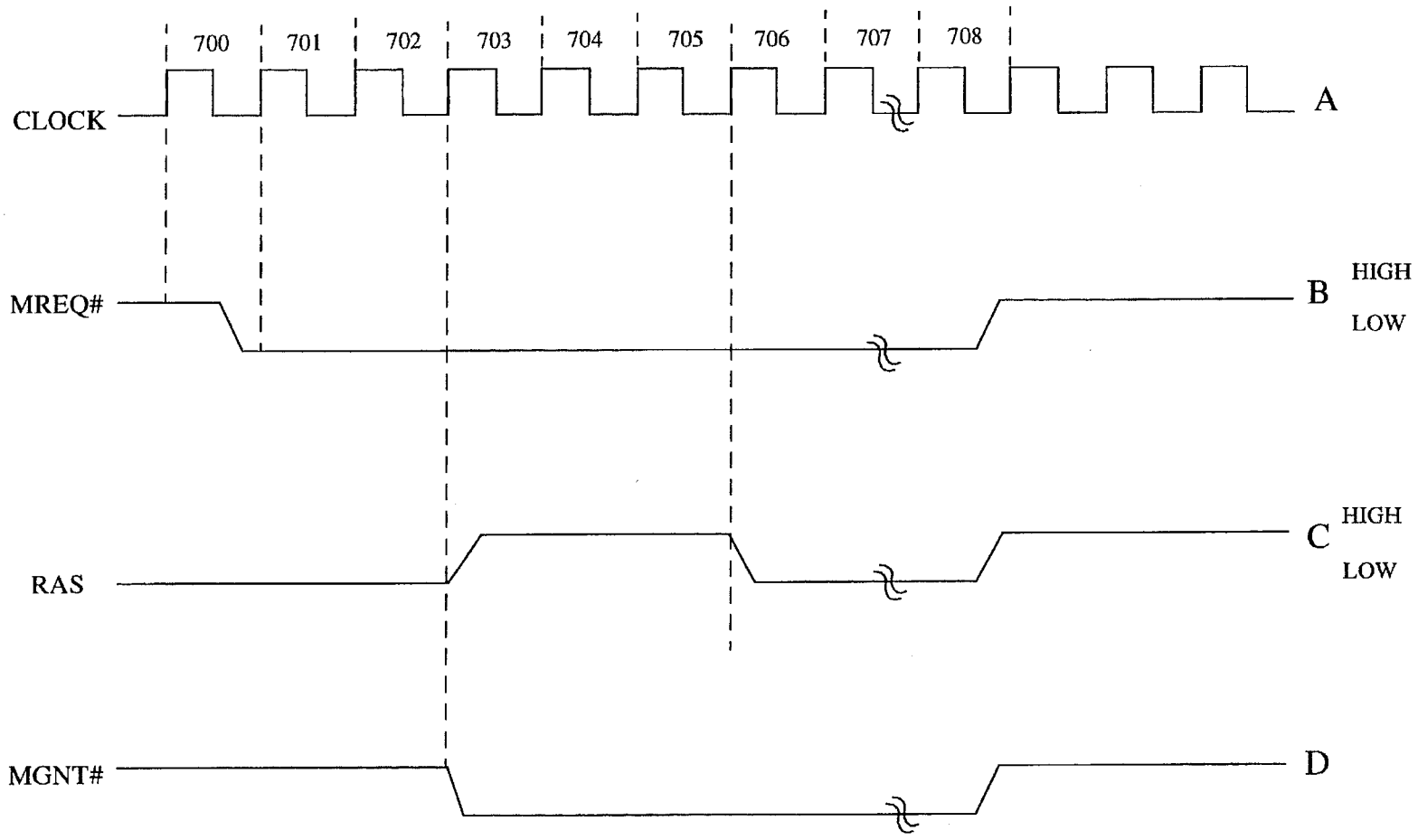
FIG. 7A is a waveform diagram illustrating the signaling scheme employed for low priority MREQ signals.

FIG. 7A illustrates the low priority MREQ signaling scheme employed by MREQ generation circuit 240 of the present invention. The MREQ signal line 250 is normally in a high state. To generate low priority MREQ signal, MREQ Generation Circuit 240 drives MREQ signal line 250 to a low logic level, and holds it at the low logic level until a MGNT signal is received.

Accordingly, an active low signal is shown during clock cycle 701 on MREQ signal line 250 indicates a request for system memory bus 173 access. During clock cycles 701 and 702, system memory bus 173 is shown to be busy as determined by an active RAS signal (only the RAS signal common to system memory and frame buffer is shown). Since the low priority MREQ signal is granted a lower priority than other requests, the MREQ signal is not honored during clock cycles 701 and 702.

In the clock cycle 703, system memory bus 173 is shown to be idle when RAS is driven inactive. Since the low priority MREQ signal is asserted, during clock cycle 703 host controller 140 grants graphics controller 200 access to System memory bus 173 by asserting the MGNT signal line (shown as active low). The graphics controller 200 starts its memory access cycle to the frame buffer during clock cycle 706, after completion of RAS precharge. The MREQ Generation Circuit 240 drives MREQ signal line 250 to a high logic level at the end of the memory access cycle of the graphics controller.

Figure 7B:
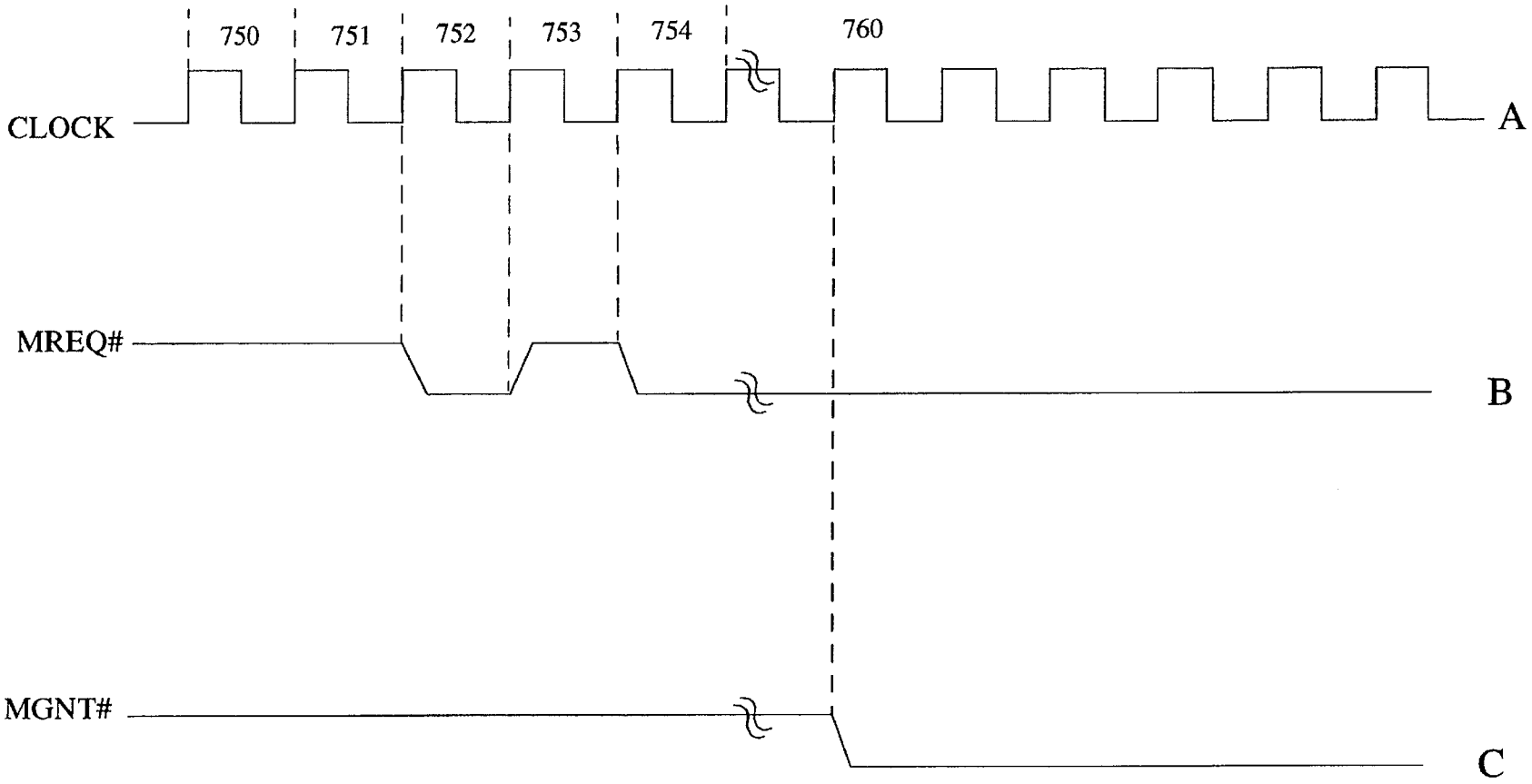
FIG. 7B is a waveform diagram illustrating the signaling scheme employed for high priority MREQ signals.

FIG. 7B illustrates the high priority MREQ signaling scheme employed by MREQ Generation Circuit 240 of the present invention. To generate a high priority MREQ signal, MREQ Generation Circuit 240 drives MREQ signal line 250 to a low logic level for only one clock cycle, then drives the MREQ signal line 250 to a high logic level, for one clock cycle, followed by driving MREQ signal line 250 back to a low logic level.

Accordingly, MREQ signal line 250 is shown at a low logic in clock cycle 752. The MREQ Generation Circuit 240 drives MREQ signal line 250 to high logic level in clock cycle 752, and back to a low logic level in clock cycle 753. Since host controller 140 of the present invention grants highest priority to high priority MREQ signal, the MGNT signal is received soon after in clock cycle 756. There may be few clock cycles between the assertion of MREQ signal and granting bus access because of other data transfers that may be occurring between other units when the graphics controller 200 asserts the MREQ signal. Once the MGNT signal is received (shown during clock cycle 760), the graphics controller 200 begins transferring a memory access cycle to the frame buffer 130.

Figure 8:
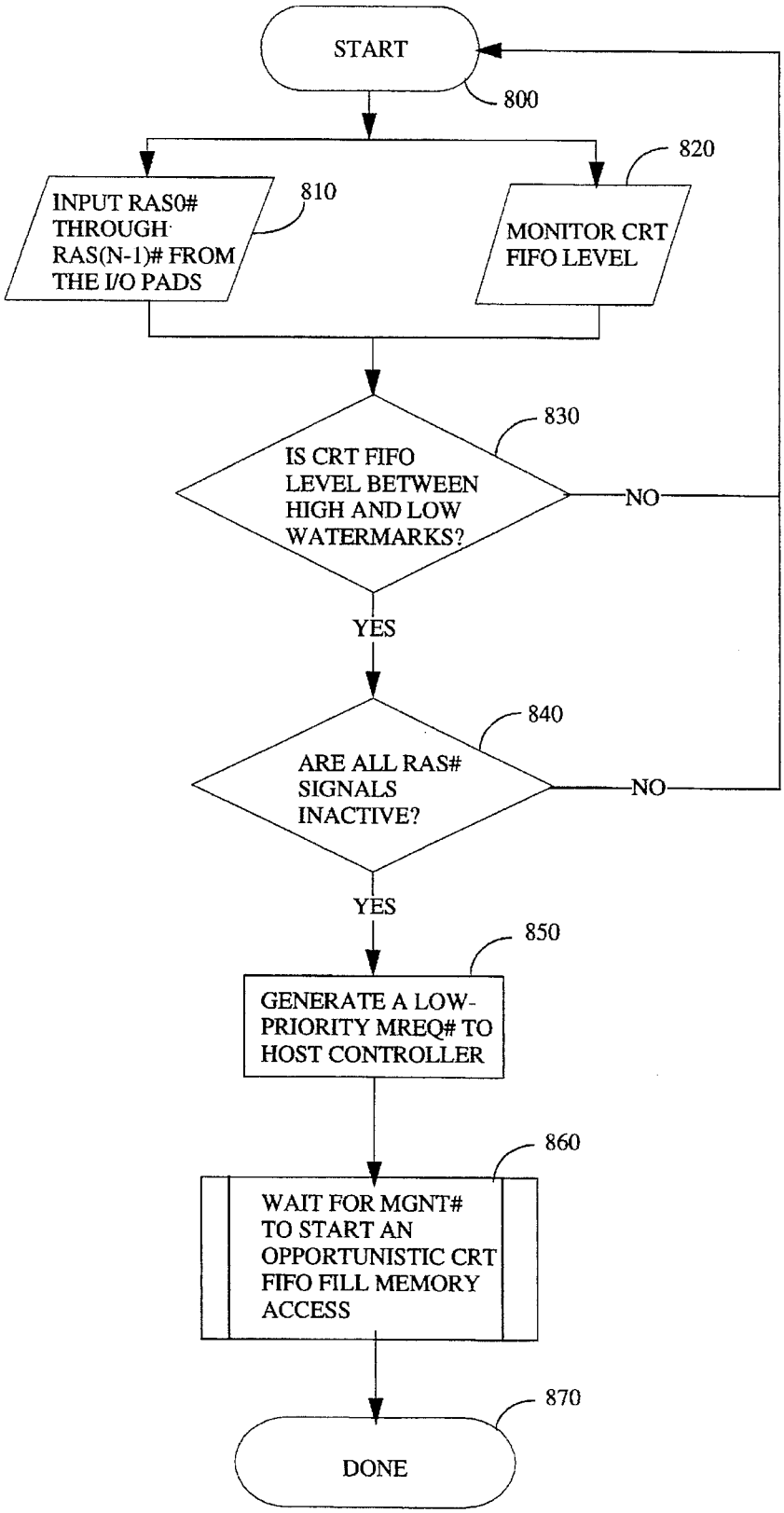
FIG. 8 is a flow chart illustrating the steps for generating the low priority MREQ signal of the present invention.

FIG. 8 is a flow chart illustrating the steps of the present invention in performing opportunistic display data read cycles from the frame buffer into CRT FIFO 220. In step 810, RAS snooping circuit 210 examines all the RAS signal lines from I/O pads 289. In parallel, during step 820, water mark determination circuit 230 examines the CRT FIFO level.

In step 830, water mark determination circuit 230 determines whether CRT FIFO level is between the high level water mark and the low level water mark. If so, graphics controller 200 continues with step 840 or else graphics controller 200 returns to step 800.

In step 840, RAS snooping circuit 210 determines whether system memory bus 170 is idle based on the status of the RAS signal lines. If the system memory bus is not idle, graphics controller 200 returns to step 800. In other words, low priority MREQ signal for opportunistic display data read is not generated until CRT FIFO level is between the high and low water marks, and system memory bus 170 is idle.

In step 850, MREQ Generation Circuit 240 generates a low priority MREQ signal by driving MREQ signal line 250 to a low logic level. The MREQ signal line 250 remains driven low until MGNT signal is received or until the CRT FIFO level falls below low level water mark, at which point, the request is upgraded to a high priority request by driving MREQ signal line 250 high for one clock cycle, followed by a low logic level.

Once the MGNT signal is received, the graphics controller begins retrieving display data from frame buffer in step 860.

Hence, graphics controller 200 of the present invention retrieves display data into the read ahead CRT FIFO 220 when system memory bus 170 is idle. makes available system memory bus 173 to other devices, such as CPU or I/O devices faster. This enhances the performance throughput of the overall information processing system 100 in which graphics controller 200 of the present invention operates.

Therefore, the present invention has been described relative to a preferred embodiment. It will be apparent to one of ordinary skill in the art after reading the teachings of this patent document that further modifications can be made without departing from the spirit and scope of the invention as defined in the claims appended hereto.

What we claim is:

1. In a computer system having a frame buffer and a system memory comprised in a single memory unit coupled to a bus, a method of displaying display data stored in the frame buffer comprising the steps of:

monitoring the bus to determine whether the bus is idle;

examining a display FIFO buffer to determine whether display data in the display FIFO buffer is below a low level water mark;

examining a display FIFO buffer to determine whether display data in the display FIFO buffer has attained a high level water mark;

transferring display data stored in the frame buffer into the display FIFO buffer over the bus if the bus is idle, transferring display data stored in the frame buffer to the display FIFO with a lower priority if the high level water mark is attained and the bus is idle, and transferring display data in the frame buffer into the display FIFO buffer with a higher priority if display data in the display FIFO buffer is below the low level water mark; and displaying display data stored in the display FIFO buffer.

2. The method of claim 1, wherein said step of monitoring said bus comprises the step of monitoring at least one of a set of RAS signals of the memory unit.

3. A graphics controller for displaying a display data stored in a frame buffer, the frame buffer and a system memory being comprised in a memory unit coupled to a bus, said graphics controller comprising:

a display FIFO for storing the display data;

a video controller for retrieving the display data from said display FIFO and sending the retrieved display data for display on a display unit;

a RAS snooper for determining whether said bus is idle by examining a set of RAS signal lines of said memory unit;

water mark determination means for determining whether a number of data items stored in said display FIFO is within a predetermined range; and a sequencer for retrieving the display data from said frame buffer if said bus is idle and for retrieving the display data from said frame buffer and storing the display data in said display FIFO if said number of data items stored in said display FIFO is within said predetermined range.

4. The graphics controller of claim 3, further comprising an MREQ generator for generating a low priority MREQ signal to a host controller controlling access to said bus.

5. The graphics controller of claim 4 wherein said MREQ generator generates a high priority MREQ signal to said host controller if said number of data items stored in said display FIFO is below a low level water mark.

6. A graphics controller for displaying a display data stored in a frame buffer, the frame buffer and a system memory being comprised in a memory unit coupled to a bus, said graphics controller comprising:

a display FIFO for storing the display data;

a video controller for retrieving the display data from said display FIFO and sending the retrieved display data for display on a display unit;

a RAS snooper for determining whether said bus is idle by examining a set of RAS signal lines of said memory unit; and a sequencer for retrieving the display data from said frame buffer if said bus is idle;

a water mark determination means for determining whether a number of data items stored in said display FIFO is within a predetermined range; and an MREQ generator for generating a low priority MREQ signal to a host controller controlling access to said bus, wherein said sequencer initiates retrieval of the display data from said frame buffer and stores in said display FIFO if said number of data items stored in said display FIFO is within said predetermined range, said MREQ generator generates a high priority MREQ signal to said host controller if said number of data items stored in said display FIFO is below a low level water mark, and said host controller is designed to give a high priority to said high priority MREQ signal, and a low priority to said low priority MREQ signal.

7. The graphics controller of claim 6 wherein said water mark determination means comprises:

a high level water mark register for storing the predetermined range;

a low level water mark register for storing the low level water mark;

a flip-flop for indicating whether to generate the low level low priority MREQ signal;

a display FIFO level counter for storing a count indicative of the number of data items;

a first comparator coupled to said display FIFO level counter and to said high level water mark register for determining whether the count of said display FIFO level counter is within the predetermined range; and a second comparator coupled to said display FIFO level counter and to said low level water mark register for determining whether the count of said display FIFO level counter is below said low level water mark.

8. The graphics controller of claim 7, wherein said first comparator comprises a first plurality of XNOR gates, each of said first plurality of XNOR gates being coupled to receive a bit of said high level water mark register and a bit of said display FIFO level counter, the outputs of said XNOR gates being coupled to an AND gate, wherein output of said AND gate is coupled to an input of said flip-flop.

9. The graphics controller of claim 8, wherein said second comparator comprises a second plurality of XNOR gates, each of said second plurality of XNOR gates being coupled to receive a bit of said low level water mark register and one of a least significant bits of said display FIFO level counter.

10. The graphics controller of claim 7, wherein said low level water mark register and said high level water mark register are programmable.

11. The graphics controller of claim 7, wherein said low level water mark register and said high level water mark register comprise a lesser number of bits than said display FIFO level counter.

12. A computer system comprising:

a frame buffer coupled to a bus;

a host controller for receiving MREQ signals and granting access to said bus;

a CPU for sending display data;

a graphics controller coupled to receive the display data and to store the display data into said frame buffer, retrieving display data into a display FIFO prior to display on a display unit, sending to said host controller a low priority MREQ signal if said bus is idle and a high priority MREQ signal if data stored in said display FIFO falls below a low level water mark, wherein said host controller grants access to said graphics controller with a lower priority in response to said low priority MREQ signal and with a high priority in response to said high priority MREQ signal, and said graphics controller transfers the display data to said display FIFO upon being granted access to said bus.

13. The computer system of claim 12, wherein said graphics controller comprises a RAS snooper for determining whether said bus is idle by examining a set of RAS signal lines of said frame buffer.

14. The computer system of claim 13, wherein said graphics controller sends a low priority MREQ signal if display data stored in said display FIFO falls below a high water mark level.

15. The computer system of claim 14, wherein said graphics controller further comprises a water mark determination means to determine whether display data in said display FIFO is below the low level water mark and the high level water mark.

16. A computer system computer system comprising:

a frame buffer coupled to a bus;

a host controller for receiving MREQ signals and granting access to said bus;

a CPU for sending display data;

a graphics controller coupled to receive the display data and to store the display data into said frame buffer, retrieving display data into a display FIFO prior to display on a display unit, sending to said host controller a low priority MREQ signal if said bus is idle and a high priority MREQ signal if data stored in said display FIFO falls below a low level water mark; said graphics controller comprising a RAS snooper for determining whether said bus is idle by examining a set of RAS signal lines of said frame buffer, a water mark determination means to determine whether display data in said display FIFO is below the low level water mark and the high level water mark, wherein said water mark determination means comprises:

a high level water mark register for storing the high level water mark;

a low level water mark register for storing the low level water mark;

a flip-flop for indicating whether to generate said low priority MREQ signal;

a display FIFO level counter for storing a count indicative of a number of data items stored in the display FIFO;

a first comparator coupled to said display FIFO level counter and to said high level water mark register for determining whether the count is within said predetermined range; and a second comparator coupled to said display FIFO level counter and to said low level water mark register for determining whether the count is below said low level priority counter, wherein said host controller grants access to said graphics controller with a lower priority in response to said low priority MREQ signal and with a high priority in response to said high priority MREQ signal, said graphics controller transfers the display data to said display FIFO upon being granted access to said bus, and said graphics controller sends a low priority MREQ signal if display data stored in said display FIFO falls below a high water mark level.

17. The computer system of claim 16, wherein said first comparator comprises a first plurality of XNOR gates, each of said first plurality of XNOR gates being coupled to receive a bit of said high level water mark register and a bit of said display FIFO level counter, the outputs of said XNOR gates being coupled to an AND gate, wherein output of said AND gate is coupled to an input of said flip-flop.

18. The computer system of claim 17, wherein said second comparator comprises a second plurality of XNOR gates, each of said second plurality of XNOR gates being coupled to receive a bit of said low level water mark register and one of a least significant bits of said display FIFO level counter.

19. The computer system of claim 16, wherein said low level water mark register and said high level water mark register are programmable.

20. The computer system of claim 16, wherein said low level water mark register and said high level water mark register comprise a lesser number of bits than said display FIFO level counter.

* * * * *